US012310451B2

(12) United States Patent
Couture

(10) Patent No.: US 12,310,451 B2
(45) Date of Patent: May 27, 2025

(54) SHOE HAVING PLURALITIES OF LUGS

(71) Applicant: Cole Haan LLC, Greenland, NH (US)

(72) Inventor: Kristafer Couture, Greenland, NH (US)

(73) Assignee: COLE HAAN LLC, Greenland, NH (US)

( * ) Notice: Subject to any disclaimer, the term of this patent is extended or adjusted under 35 U.S.C. 154(b) by 109 days.

(21) Appl. No.: 17/994,797

(22) Filed: Nov. 28, 2022

(65) Prior Publication Data

US 2024/0172839 A1 May 30, 2024

(51) Int. Cl.
*A43B 13/22* (2006.01)

(52) U.S. Cl.
CPC ..... *A43B 13/223* (2013.01)

(58) Field of Classification Search
USPC ..... D2/957, 960
See application file for complete search history.

(56) References Cited

U.S. PATENT DOCUMENTS

| | | | | |
|---|---|---|---|---|
| 4,083,125 | A * | 4/1978 | Benseler | A43B 7/081 36/32 R |
| 6,615,512 | B2 | 9/2003 | Sink | |
| 6,817,117 | B1 | 11/2004 | Campbell | |
| D539,516 | S * | 4/2007 | McClaskie | D2/951 |
| D545,534 | S * | 7/2007 | McClaskie | D2/960 |
| D560,885 | S | 2/2008 | Lane, III et al. | |
| D573,330 | S | 7/2008 | Robinson, Jr. et al. | |
| 7,895,773 | B2 * | 3/2011 | Robinson, Jr. | A43B 13/189 36/153 |
| 8,375,604 | B2 * | 2/2013 | Eder | A43B 13/223 36/114 |
| 8,418,382 | B2 * | 4/2013 | Madore | A43B 7/24 36/102 |
| D707,430 | S | 6/2014 | Feeney et al. | |
| 8,863,410 | B2 | 10/2014 | Schmid | |
| D726,998 | S | 4/2015 | Mochen | |
| D804,793 | S * | 12/2017 | Lee | D2/947 |
| 2006/0130361 | A1 * | 6/2006 | Robinson | A43B 13/10 36/102 |
| 2014/0215853 | A1 * | 8/2014 | Rushbrook | A43B 5/001 36/102 |

FOREIGN PATENT DOCUMENTS

| | | |
|---|---|---|
| CN | 205030614 U | 2/2016 |

* cited by examiner

*Primary Examiner* — Jila M Mohandesi
(74) *Attorney, Agent, or Firm* — Thompson Coburn LLP

(57) ABSTRACT

A shoe comprising a sole and an upper secured to the sole. The sole has a sole bottom surface, first lugs, second lugs, third lugs, and fourth lugs. The first, second, third, and fourth lugs project downward from the sole bottom surface. The first lugs are of a shape different from the shapes of the second, third, and fourth lugs. The second lugs are of a shape different from the third and fourth lugs. The third lugs are of a different shape from the fourth lugs.

21 Claims, 10 Drawing Sheets

SHOE HAVING PLURALITIES OF LUGS

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to a shoe having pluralities of lugs.

SUMMARY

One aspect of the disclosure is a shoe comprising a sole and an upper secured to the sole. The sole has a sole heel end and a sole toe end, and the sole extends along a shoe axis from the sole heel end to the sole toe end. The sole has a lateral side extending from the sole heel end to the sole toe end and a medial side extending from the sole heel end to the sole toe end. The sole extends transversely from the lateral side to the medial side. The sole has a sole heel region, a sole midfoot region, a sole forefoot region, a sole ball region, a sole metatarsal region, and a sole toe region. The sole heel region extends longitudinally from the sole heel end to the sole midfoot region. The sole midfoot region extends longitudinally from the sole heel region to the sole forefoot region. The sole forefoot region extends longitudinally from the sole midfoot region to the sole ball region. The sole ball region extends longitudinally from the sole forefoot region to the sole metatarsal region. The sole metatarsal region extends longitudinally from the sole ball region to the toe region. The sole toe region extends longitudinally from the sole metatarsal region to the sole toe end. The sole heel region has a lateral heel portion and a medial heel portion. The sole midfoot region has a lateral midfoot portion and a medial midfoot portion. The sole forefoot region has a lateral forefoot portion and a medial forefoot portion. The sole ball region has a lateral midfoot portion and a medial midfoot portion. The sole metatarsal region has a lateral metatarsal portion and a medial metatarsal portion. The sole toe region has a lateral toe portion and a medial toe portion. The sole has a sole bottom surface, first lugs, second lugs, third lugs, and fourth lugs. The first, second, third, and fourth lugs project downward from the sole bottom surface. The first lugs are of a shape different from the shapes of the second, third, and fourth lugs. The second lugs are of a shape different from the third and fourth lugs. The third lugs are of a different shape from the fourth lugs.

Another aspect of the disclosure is a shoe comprising a sole and an upper secured to the sole. The sole has a sole heel end and a sole toe end, and the sole extends along a shoe axis from the sole heel end to the sole toe end. The sole has a lateral side extending from the sole heel end to the sole toe end and a medial side extending from the sole heel end to the sole toe end. The sole extends transversely from the lateral side to the medial side. The sole has a sole heel region, a sole midfoot region, a sole forefoot region, a sole ball region, a sole metatarsal region, and a sole toe region. The sole heel region extends longitudinally from the sole heel end to the sole midfoot region. The sole midfoot region extends longitudinally from the sole heel region to the sole forefoot region. The sole forefoot region extends longitudinally from the sole midfoot region to the sole ball region. The sole ball region extends longitudinally from the sole forefoot region to the sole metatarsal region. The sole metatarsal region extends longitudinally from the sole ball region to the toe region. The sole toe region extends longitudinally from the sole metatarsal region to the sole toe end. The sole heel region has a lateral heel portion and a medial heel portion. The sole midfoot region has a lateral midfoot portion and a medial midfoot portion. The sole forefoot region has a lateral forefoot portion and a medial forefoot portion. The sole ball region has a lateral midfoot portion and a medial midfoot portion. The sole metatarsal region has a lateral metatarsal portion and a medial metatarsal portion. The sole toe region has a lateral toe portion and a medial toe portion. The sole has a sole bottom surface, first lugs, second lugs, third lugs, and fourth lugs. The first, second, third, and fourth lugs project downward from the sole bottom surface. The first lugs are of a shape different from the shapes of the second, third, and fourth lugs. The second lugs are of a shape different from the third and fourth lugs. The third lugs are of a different shape from the fourth lugs. At least two of the first lugs are within the medial toe portion, and at least two of the first lugs are within the lateral heel portion. At least two of the second lugs are within at least one of the medial metatarsal portion, the medial ball portion, and the medial forefoot portion, and at least two of the second lugs are within the lateral midfoot portion. At least two of the third lugs are within the medial heel portion, and at least two of the third lugs are within the lateral toe portion. At least two of the fourth lugs are within the medial midfoot portion, and at least two of the fourth lugs are within at least one of the lateral metatarsal portion, the lateral ball portion, and the lateral forefoot portion.

Further features and advantages, as well as the operation, are described in detail below with reference to the accompanying drawings.

Figure 1:
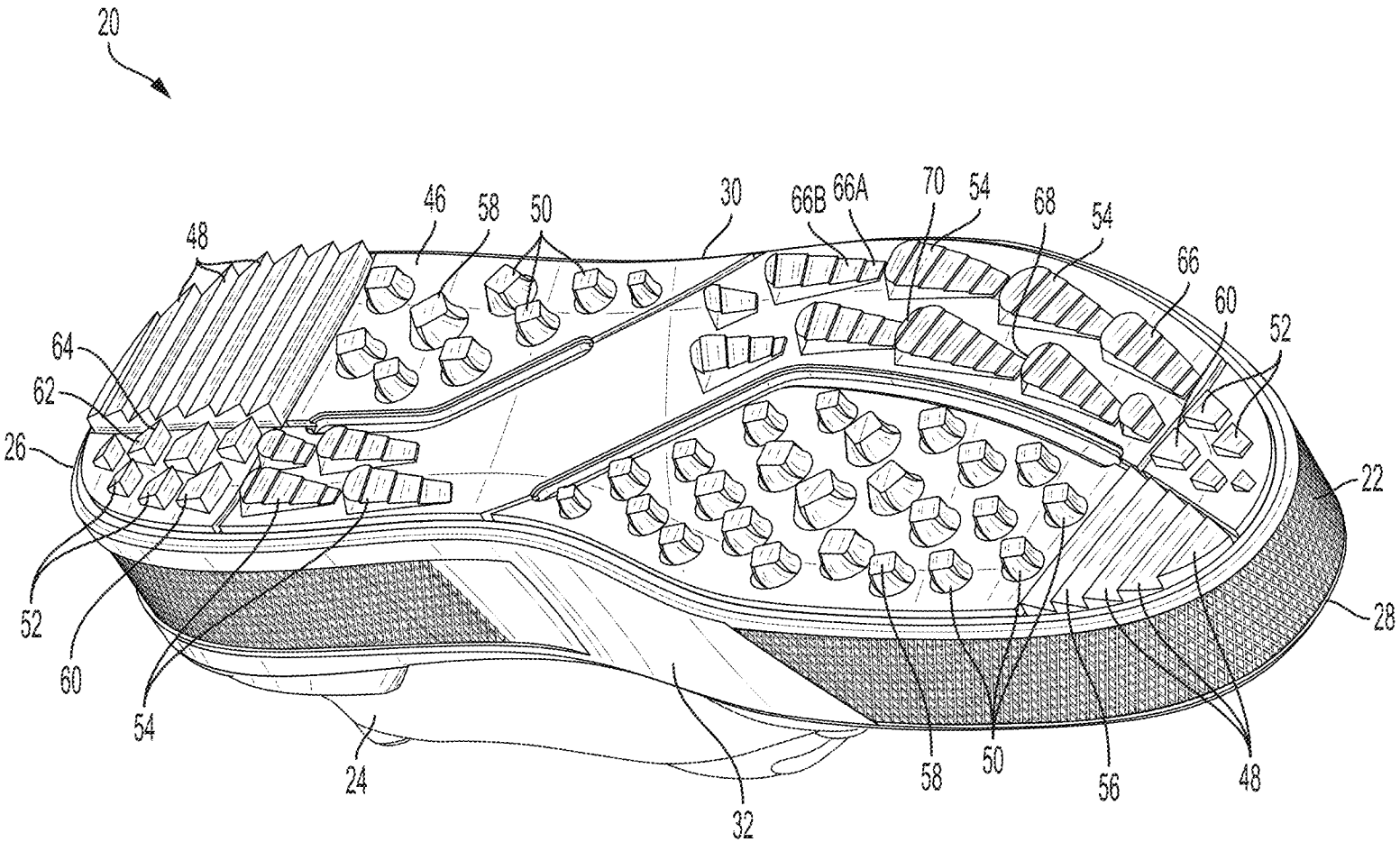
FIG. 1 is a bottom-front isometric view of a shoe of the present disclosure.

Reference numerals in the written specification and in the figures indicate corresponding items.

DETAILED DESCRIPTION

An embodiment of a shoe in accordance with the present invention is indicated generally by reference number 20. The shoe 20 comprises a sole 22 and an upper 24 secured to the sole.

The sole 22 has a sole heel end 26 and a sole toe end 28, and the sole extends along a shoe axis $X_s$ from the sole heel end to the sole toe end. The sole 22 has a lateral side 30 extending from the sole heel end 26 to the sole toe end 28 and a medial side 32 extending from the sole heel end to the sole toe end. The sole 22 extends transversely from the lateral side 30 to the medial side 32.

The sole 22 has a sole heel region 34, a sole midfoot region 36, a sole forefoot region 38, a sole ball region 40, a sole metatarsal region 42, and a sole toe region 44. The sole heel region 34 extends longitudinally from the sole heel end 26 to the sole midfoot region 36. The sole midfoot region 36 extends longitudinally from the sole heel region 34 to the sole forefoot region 38. The sole forefoot region 38 extends longitudinally from the sole midfoot region 36 to the sole ball region 40. The sole ball region 40 extends longitudinally from the sole forefoot region 38 to the sole metatarsal region 42. The sole metatarsal region 42 extends longitudinally from the sole ball region 40 to the toe region 44. The sole toe region 44 extends longitudinally from the sole metatarsal region 42 to the sole toe end 28.

The sole heel region 34 has a lateral heel portion 34L and a medial heel portion 34M. The sole midfoot region 36 has a lateral midfoot portion 36L and a medial midfoot portion 36M. The sole forefoot region 38 has a lateral forefoot portion 38L and a medial forefoot portion 38M. The sole ball region 40 has a lateral ball portion 40L and a medial ball portion 40M. The sole metatarsal region 42 has a lateral metatarsal portion 42L and a medial metatarsal portion 42M. The sole toe region 44 has a lateral toe portion 44L and a medial toe portion 44M.

The sole 22 has a sole bottom surface 46, first lugs 48, second lugs 50, third lugs 52, and fourth lugs 54. The first, second, third, and fourth lugs 48, 50, 52, 54 project downward from the sole bottom surface 46. The first lugs 48 are of a shape different from the shapes of the second, third, and fourth lugs 50, 52, 54. The second lugs 50 are of a shape different from the third and fourth lugs 52, 54. The third lugs 52 are of a different shape from the fourth lugs 54.

Figure 2:
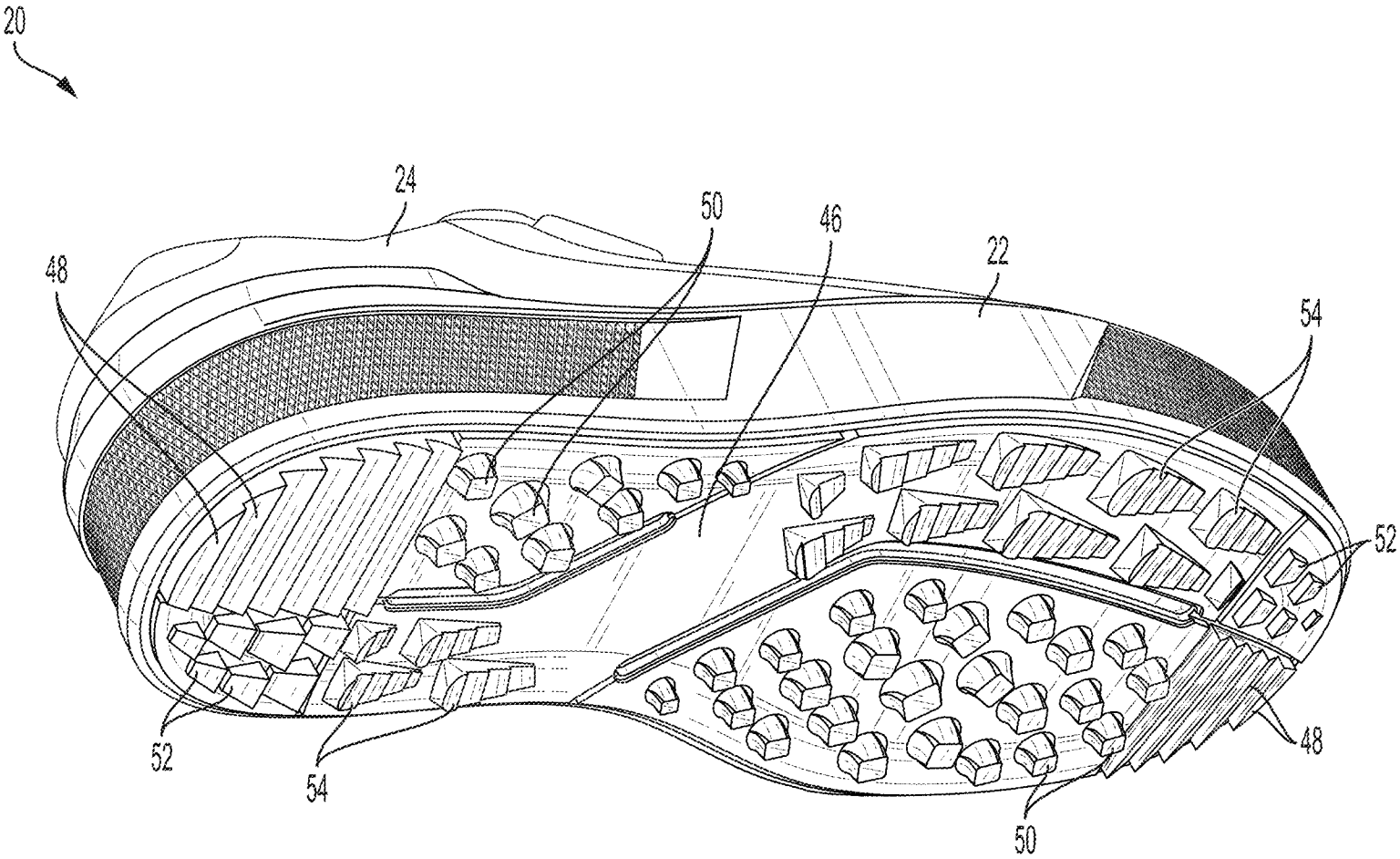
FIG. 2 is a bottom-rear isometric view of the shoe of FIG. 1.
Figure 3:
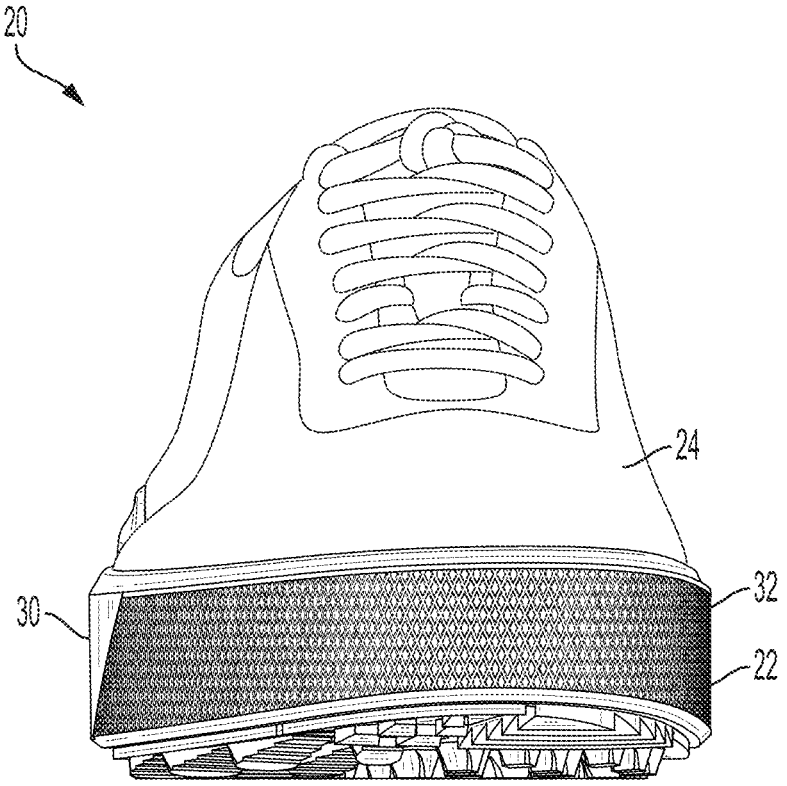
FIG. 3 is a front view of the shoe of FIG. 1.
Figure 4:
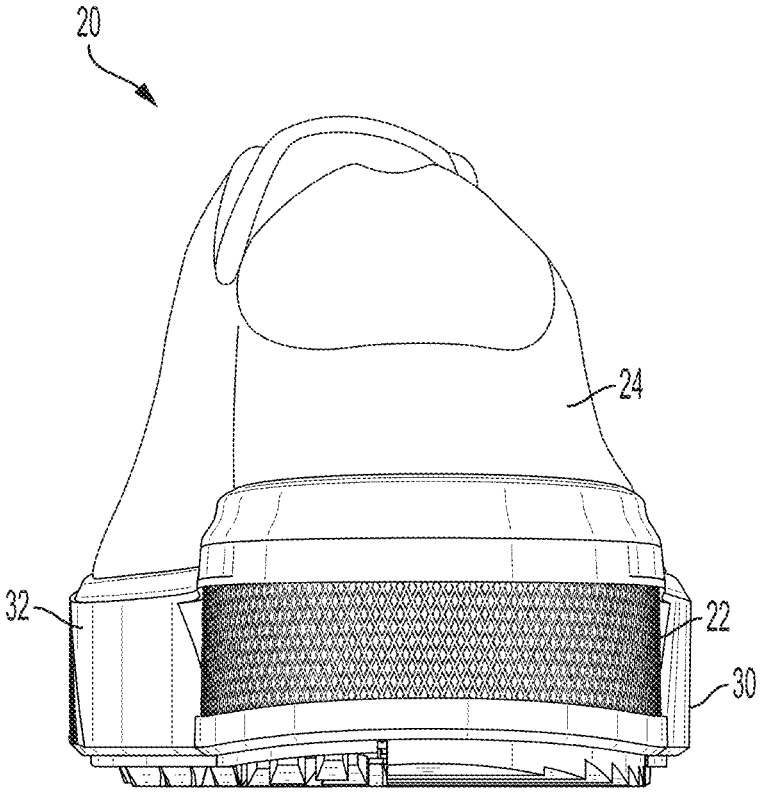
FIG. 4 is a rear view of the shoe of FIG. 1.
Figure 5:
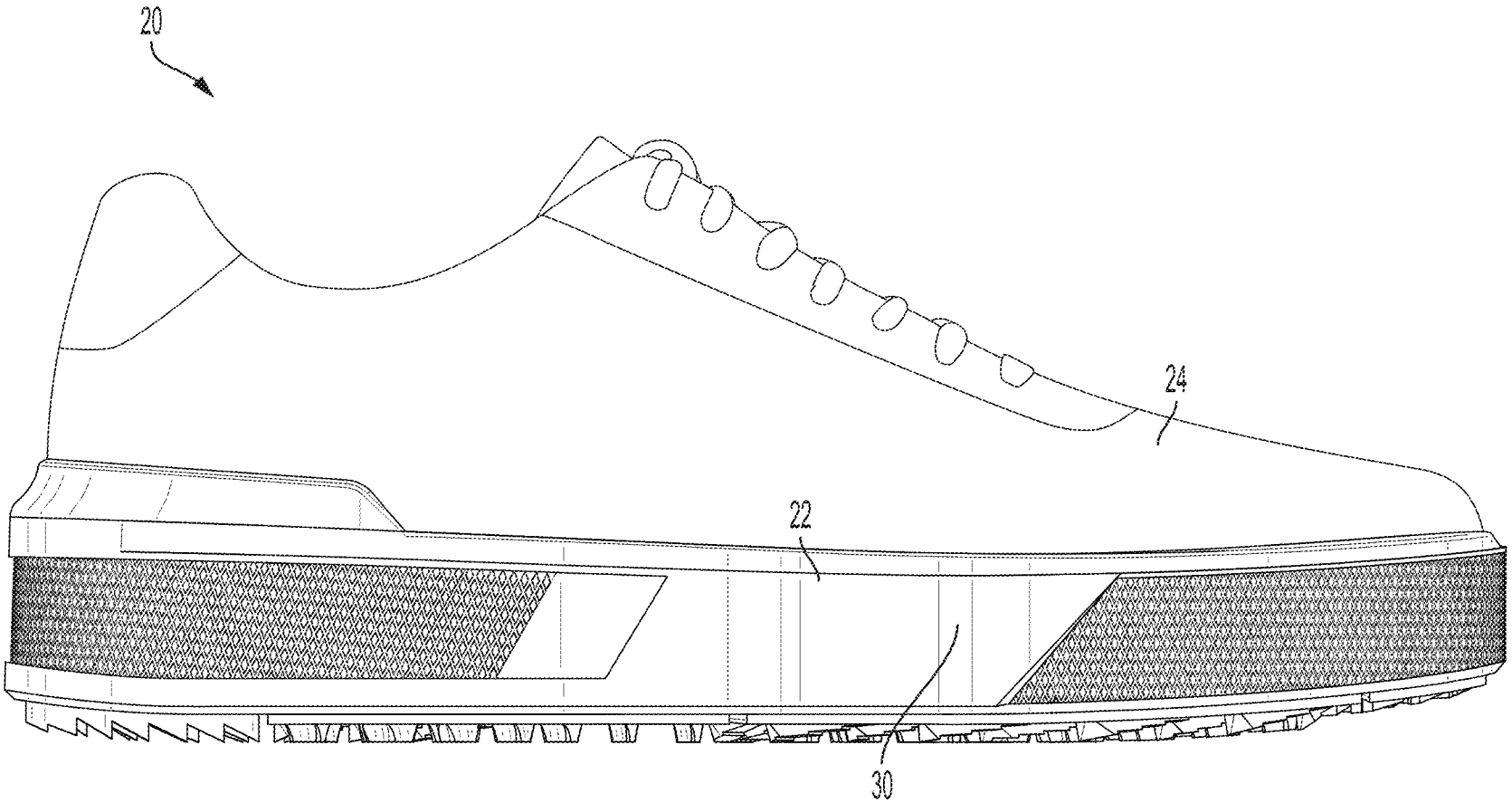
FIG. 5 is a lateral side view of the shoe of FIG. 1.
Figure 6:
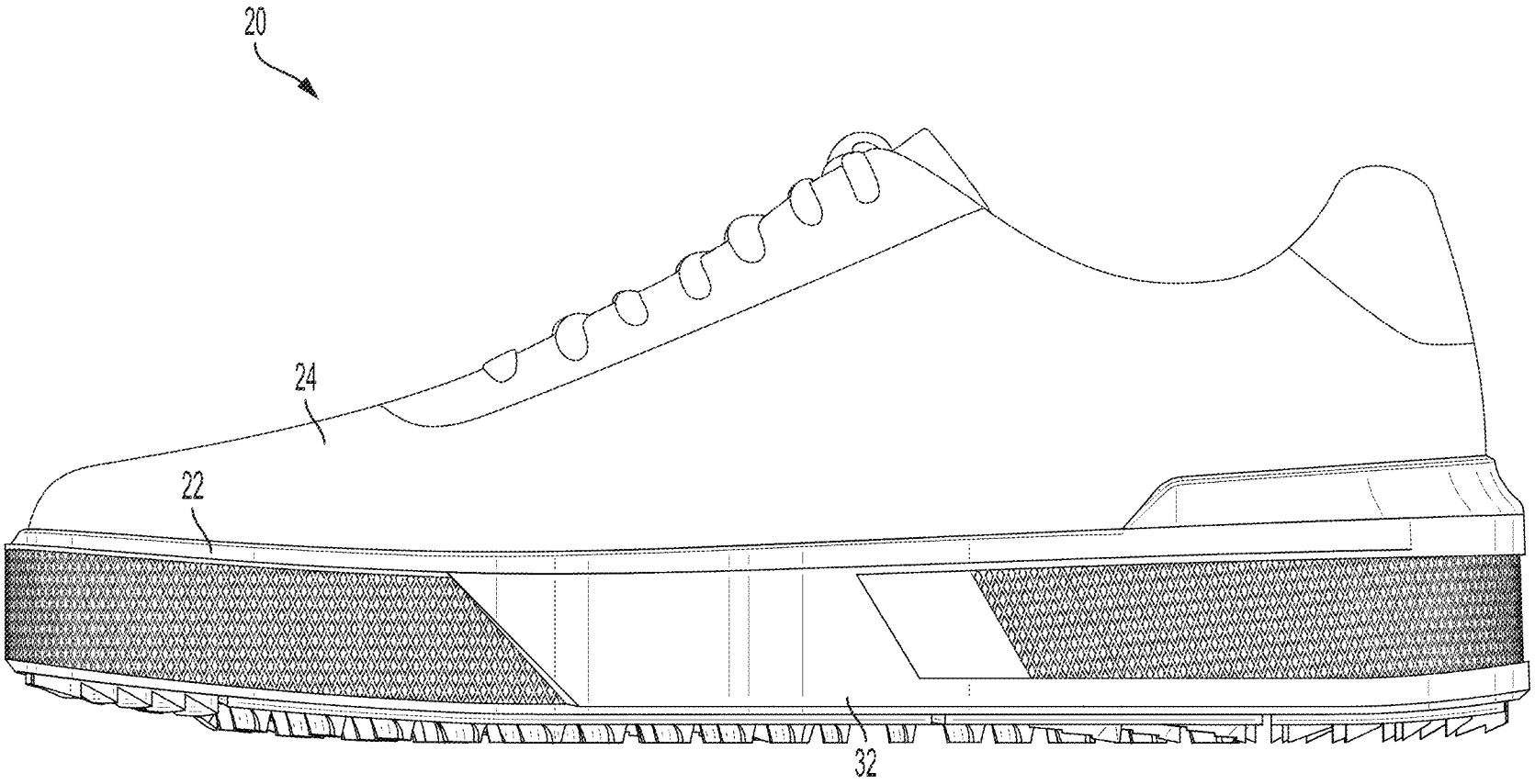
FIG. 6 is a medial side view of the shoe of FIG. 1.
Figure 7:
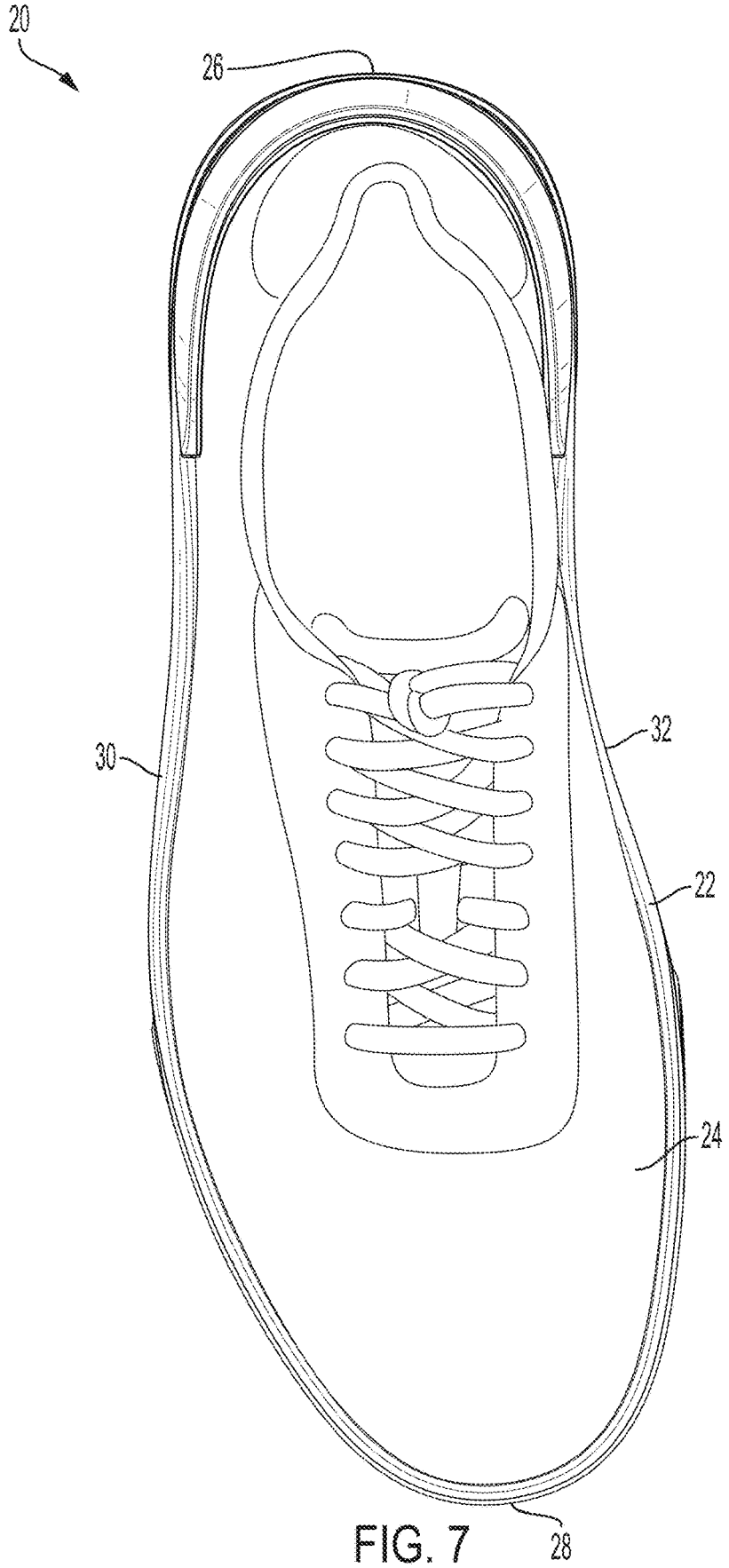
FIG. 7 is a top view of the shoe of FIG. 1.
Figure 8:
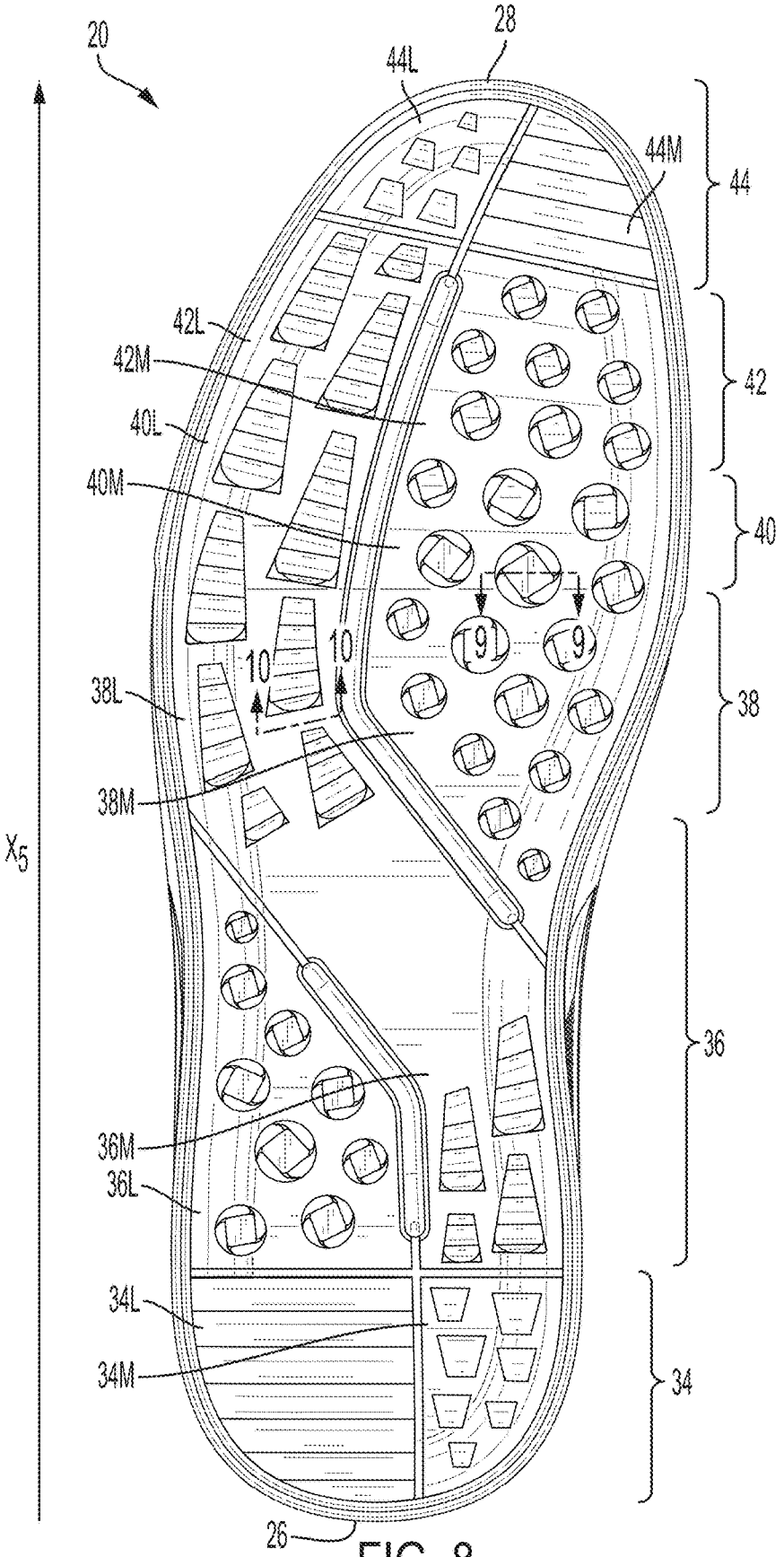
FIG. 8 is a bottom view of the shoe of FIG. 1.
Figure 9:
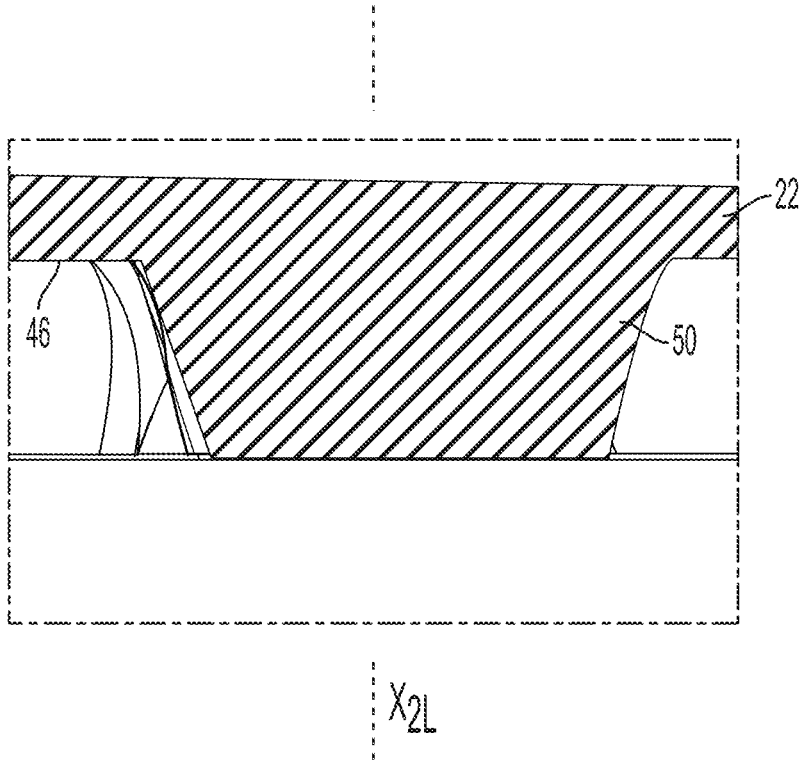
FIG. 9 is a magnified section view of an exemplary second lug, taken along the line 9-9 in FIG. 8.
Figure 10:
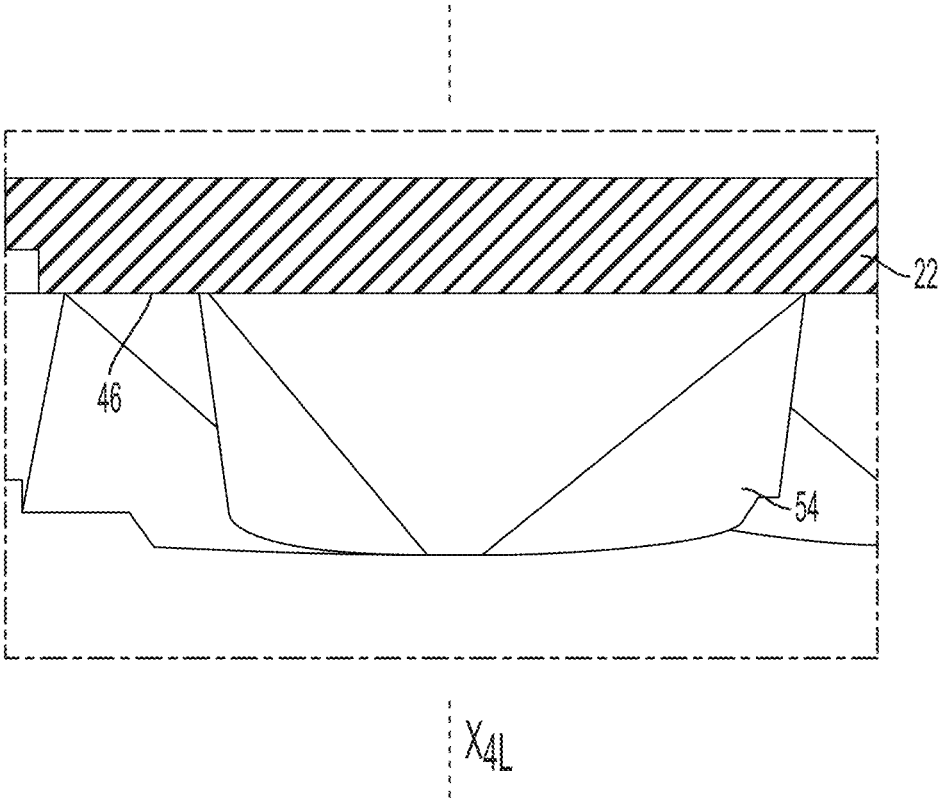
FIG. 10 is a magnified section view of an exemplary fourth lug, taken along the line 10-10 in FIG. 8.

At least two of the first lugs 48 may be within the medial toe portion 44M, and at least two of the first lugs may be within the lateral heel portion 34L. The first lugs 48 may comprise ridges 56 extending transversely between the medial and lateral sides 30, 32. The at least two first lugs 48 within the medial toe portion 44M may have a forwardly facing sloping surface, and the at least two first lugs within the lateral heel portion 34L may have a rearwardly facing sloping surface. Each of the first lugs 48 may slope at an angle from the sole bottom surface 46 of between 5° and 85° inclusive. For example, each of the first lugs 48 may slope at an angle from the sole bottom surface 46 of between 30° and 60° inclusive. As shown in FIGS. 1-2 and 8, the disclosed embodiment has five first lugs in the medial toe portion 34M and seven first lugs in the lateral heel portion 34L.

At least two of the second lugs 50 may be within at least one of the medial metatarsal portion 42M, the medial ball portion 40M, and the medial forefoot portion 38M. Alternatively, at least two of the second lugs 50 may be within each of the medial metatarsal portion 42M, the medial ball portion 40M, and the medial forefoot portion 38M. At least two of the second lugs 50 may be within the lateral midfoot portion 38L. Each of the second lugs 50 project downward from the sole bottom surface 46 to a second lug bottom surface 58 along a second lug axis $X_{2L}$. The second lug bottom surface 58 may be generally parallel to the sole bottom surface 46. Each of the second lugs 50 may be generally square in a cross section perpendicular to the corresponding second lug axis $X_{2L}$, and each of the second lugs may taper away from the sole bottom surface. It should be understood that the second lugs 50 may have rounded edges (e.g., filleted edges) and still have a generally square cross section. The second lugs 50 may be aligned uniformly (i.e., one or more edges of each square cross section is parallel to an edge of an adjacent cross section) or the lugs may be arranged non-uniformly. For example, some of the lugs may be rotated in relation to adjacent lugs. As shown in FIGS. 1-2 and 8, the disclosed embodiment has a combined twenty-four second lugs within the medial metatarsal portion 42M, the medial ball portion 40M, and the medial forefoot portion 38M. The disclosed embodiment has nine second lugs within the lateral midfoot portion 38L.

At least two of the third lugs 52 may be within the medial heel portion 34M and at least two of the third lugs may be within the lateral toe portion 44L. Each of the third lugs may project downward from the sole bottom surface 46 to a third lug bottom surface 60. The third lug bottom surface may have a narrow end 62 and a wide end 64. The narrow end may be closer to the sole bottom surface 46 than the wide end. For each of the third lugs 52 within the medial heel portion 34M, the wide end 64 may be closer to the sole toe end 28 than is the narrow end 62. For each of the third lugs 52 within the lateral toe region 44L, the wide end 64 may be closer to the sole heel end 26 than is the narrow end 62. As shown in FIGS. 1-2 and 8, the disclosed embodiment has five third lugs in the lateral toe portion 44L and seven third lugs in the medial heel portion 34M.

At least two of the fourth lugs 54 may be within the medial midfoot portion 36M and at least two of the fourth lugs may be within at least one of the lateral metatarsal portion 42L, the lateral ball portion 40L, and the lateral forefoot portion 38L. Alternatively, at least two of the fourth lugs may be within each of the lateral metatarsal portion 42L, the lateral ball portion 40L, and the lateral forefoot portion 38L. Each of the fourth lugs 54 may project downward from the sole bottom surface 46 to a fourth lug bottom surface 66 along a fourth lug axis $X_{4L}$. Each of the fourth lug bottom surfaces 66 may have a narrow end 68 and a wide end 70. The narrow end 68 may be closer to the sole bottom surface 46 than the wide end 70. Each of the fourth lug bottom surfaces 66 may extend from the narrow end 68 to the wide end 70 in a stepped manner such that each of the fourth lug bottom surfaces has at least a first bottom surface portion 66A and a second surface portion 66B. Both the first and second bottom surface portions 66A, 66B of each of the fourth lug bottom surfaces 66 may be generally perpendicular to the respective fourth lug axis $X_{4L}$. The first bottom surface portion 66A may be closer to the sole bottom surface than the second bottom surface portion 66B. It should be understood that some of the fourth lugs 54 may have additional bottom surface portions in addition to the first and second bottom surface portions 66A, 66B. For instance some of the fourth lugs 54 may have four bottom surface portions, some of the fourth lugs may have five bottom surface portions, and some of the fourth lugs may have six bottom surface portions. The narrow end 68 of each of the fourth lugs 54 may be closer to the sole toe end 28 than the wide end 70 of each of the fourth lugs. As shown in FIGS. 1-2 and 8, the disclosed embodiment has a combined ten fourth lugs within the lateral metatarsal portion 42L, the lateral ball portion 40L, and the lateral forefoot portion 38L. The disclosed embodiment also has four fourth lugs within the medial midfoot portion 36M.

It should be understood that, for each of the first, second, third, and fourth lugs, more or fewer lugs could be included than are shown in the disclosed embodiment. For example, in an alternative embodiment, the shoe could have from three to seven first lugs in the medial toe portion, three to eight first lugs in the lateral heel portion, three to thirty second lugs within the medial metatarsal portion, the medial ball portion, and the medial forefoot portion, three to fifteen second lugs within the lateral midfoot portion, three to eight third lugs in the lateral toe portion, three to ten third lugs in the medial heel portion, three to twelve fourth lugs within the lateral metatarsal portion, the lateral ball portion, and the lateral forefoot portion, and three to seven fourth lugs within the medial midfoot portion.

At least a 1 inch by 1 inch portion of the midfoot region 36 may be devoid of lugs. The first and second lugs 48, 50 may comprise a first material (e.g., thermoplastic polyurethane (TPU), ethylene-vinyl acetate (EVA), a dandelion latex foam or non-foam material, rubber, or another suitable material) and the third and fourth lugs 52, 54 may comprise a second material (e.g., thermoplastic polyurethane (TPU), ethylene-vinyl acetate (EVA), a dandelion latex foam or non-foam material, rubber, or another suitable material). Similarly, the first and second lugs 48, 50 may comprise a first color and the third and fourth lugs 52, 54 may comprise a second color.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A shoe comprising:

a sole; and an upper secured to the sole;

the sole having a sole heel end and a sole toe end, the sole extending along a shoe axis from the sole heel end to the sole toe end, the sole having a lateral side extending from the sole heel end to the sole toe end and a medial side extending from the sole heel end to the sole toe end, the sole extending transversely from the lateral side to the medial side, the sole having a sole heel region, a sole midfoot region, a sole forefoot region, a sole ball region, a sole metatarsal region, and a sole toe region, the sole heel region extending longitudinally from the sole heel end to the sole midfoot region, the sole midfoot region extending longitudinally from the sole heel region to the sole forefoot region, the sole forefoot region extending longitudinally from the sole midfoot region to the sole ball region, the sole ball region extending longitudinally from the sole forefoot region to the sole metatarsal region, the sole metatarsal region extending longitudinally from the sole ball region to the toe region, the sole toe region extending longitudinally from the sole metatarsal region to the sole toe end, the sole heel region having a lateral heel portion and a medial heel portion, the sole midfoot region have a lateral midfoot portion and a medial midfoot portion, the sole forefoot region having a lateral forefoot portion and a medial forefoot portion, the sole ball region having a lateral midfoot portion and a medial midfoot portion, the sole metatarsal region having a lateral metatarsal portion and a medial metatarsal portion, the sole toe region having a lateral toe portion and a medial toe portion;

the sole having a sole bottom surface, first lugs, second lugs, third lugs, and fourth lugs, the first, second, third, and fourth lugs projecting downward from the sole bottom surface, the first lugs being of a shape different from the shapes of the second, third, and fourth lugs, the second lugs being of a shape different from the third and fourth lugs, and the third lugs being of a different shape from the fourth lugs;

at least two of the first lugs being within the medial toe portion, at least two of the first lugs being within the lateral heel portion, at least two of the second lugs being within at least one of the medial metatarsal portion, the medial ball portion, and the medial forefoot portion, at least two of the second lugs being within the lateral midfoot portion, at least two of the third lugs being within the medial heel portion, at least two of the third lugs being within the lateral toe portion, at least two of the fourth lugs being within the medial midfoot portion, and at least two of the fourth lugs being within at least one of the lateral metatarsal portion, the lateral ball portion, and the lateral forefoot portion;

wherein the first lugs comprise ridges extending transversely between the medial and lateral sides, the at least two first lugs within the medial toe portion having a forwardly facing sloping surface, the at least two first lugs within the lateral heel portion having a rearwardly facing sloping surface.

2. The shoe of claim 1 wherein each of the second lugs project downward from the sole bottom surface to a second lug bottom surface along a second lug axis, each of the second lugs being generally square in a cross section perpendicular to the corresponding second lug axis, each of the second lugs tapering away from the sole bottom surface.

3. The shoe of claim 2 wherein each of the third lugs project downward from the sole bottom surface to a third lug bottom surface, the third lug bottom surface having a narrow end and a wide end, the narrow end being closer to the sole bottom surface than the wide end.

4. The shoe of claim 3 wherein each of the fourth lugs project downward from the sole bottom surface to a fourth lug bottom surface along a fourth lug axis, each of the fourth lug bottom surfaces having a narrow end and a wide end, the narrow end being closer to the sole bottom surface than the wide end, each of the fourth lug bottom surfaces extending from the narrow end to the wide end in a stepped manner such that each of the fourth lug bottom surfaces has at least a first bottom surface portion and a second surface portion, both the first and second bottom surface portions of each of the fourth lug bottom surfaces being generally perpendicular to the respective fourth lug axis, the first bottom surface portion being closer to the sole bottom surface than the second bottom surface portion.

5. The shoe of claim 4 wherein the sloping surface of each of the first lugs slopes at an angle from the sole bottom surface of between 30° and 60° inclusive.

6. The shoe of claim 4 wherein for each of the third lugs within the medial heel portion, the wide end is closer to the sole toe end than is the narrow end, and wherein for each of the third lugs within the lateral toe region, the wide end is closer to the sole heel end than is the narrow end.

7. The shoe of claim 4 wherein the narrow end of each of the fourth lugs is closer to the sole toe end than the wide end of each of the fourth lugs.

8. The shoe of claim 4 wherein at least a 1 inch by 1 inch portion of the midfoot region is devoid of lugs.

9. The shoe of claim 4 wherein the first and second lugs comprise a first material and wherein the third and fourth lugs comprise a second material.

10. The shoe of claim 4 wherein the first and second lugs comprise a first color and wherein the third and fourth lugs comprise a second color.

11. The shoe of claim 1 wherein at least two of the second lugs are in each of the medial metatarsal portion, the medial ball portion, and the medial forefoot portion and at least two of the second lugs are within the lateral midfoot portion.

12. The shoe of claim 1 wherein each of the third lugs project downward from the sole bottom surface to a third lug bottom surface, the third lug bottom surface having a narrow end and a wide end, the narrow end being closer to the sole bottom surface than the wide end.

13. The shoe of claim 12 wherein for each of the third lugs within the medial heel portion, the wide end is closer to the sole toe end than is the narrow end, and wherein for each of the third lugs within the lateral toe region, the wide end is closer to the sole heel end than is the narrow end.

14. The shoe of claim 1 wherein each of the fourth lugs project downward from the sole bottom surface to a fourth lug bottom surface along a fourth lug axis, each of the fourth lug bottom surfaces having a narrow end and a wide end, the narrow end being closer to the sole bottom surface than the wide end, each of the fourth lug bottom surfaces extending from the narrow end to the wide end in a stepped manner such that each of the fourth lug bottom surfaces has at least a first bottom surface portion and a second surface portion, both the first and second bottom surface portions of each of the fourth lug bottom surfaces being generally perpendicular to the respective fourth lug axis, the first bottom surface portion being closer to the sole bottom surface than the second bottom surface portion.

15. The shoe of claim 14 wherein the narrow end of each of the fourth lugs is closer to the sole toe end than the wide end of each of the fourth lugs.

16. The shoe of claim 1 wherein the sloping surface of each of the first lugs slopes at an angle from the sole bottom surface of between 30° and 60° inclusive.

17. The shoe of claim 1 wherein at least a 1 inch by 1 inch portion of the midfoot region is devoid of lugs.

18. The shoe of claim 1 wherein the first and second lugs comprise a first material and wherein the third and fourth lugs comprise a second material.

19. The shoe of claim 1 wherein the first and second lugs comprise a first color and wherein the third and fourth lugs comprise a second color.

20. A shoe comprising:

a sole; and an upper secured to the sole;

the sole having a sole heel end and a sole toe end, the sole extending along a shoe axis from the sole heel end to the sole toe end, the sole having a lateral side extending from the sole heel end to the sole toe end and a medial side extending from the sole heel end to the sole toe end, the sole extending transversely from the lateral side to the medial side, the sole having a sole heel region, a sole midfoot region, a sole forefoot region, a sole ball region, a sole metatarsal region, and a sole toe region, the sole heel region extending longitudinally from the sole heel end to the sole midfoot region, the sole midfoot region extending longitudinally from the sole heel region to the sole forefoot region, the sole forefoot region extending longitudinally from the sole midfoot region to the sole ball region, the sole ball region extending longitudinally from the sole forefoot region to the sole metatarsal region, the sole metatarsal region extending longitudinally from the sole ball region to the toe region, the sole toe region extending longitudinally from the sole metatarsal region to the sole toe end, the sole heel region having a lateral heel portion and a medial heel portion, the sole midfoot region have a lateral midfoot portion and a medial midfoot portion, the sole forefoot region having a lateral forefoot portion and a medial forefoot portion, the sole ball region having a lateral midfoot portion and a medial midfoot portion, the sole metatarsal region having a lateral metatarsal portion and a medial metatarsal portion, the sole toe region having a lateral toe portion and a medial toe portion;

the sole having a sole bottom surface, first lugs, second lugs, and third lugs, the first, second, and third lugs projecting downward from the sole bottom surface, the first lugs being of a shape different from the shapes of the second and third lugs, the second lugs being of a shape different from the third lugs;

at least two of the first lugs being within the medial toe portion, at least two of the first lugs being within the lateral heel portion, at least two of the second lugs being within at least one of the medial metatarsal portion, the medial ball portion, and the medial forefoot portion, at least two of the third lugs being within the lateral toe portion;

wherein the first lugs comprise ridges extending transversely between the medial and lateral sides, the at least two first lugs within the medial toe portion having a forwardly facing sloping surface, the at least two first lugs within the lateral heel portion having a rearwardly facing sloping surface.

21. The shoe of claim 20 wherein each of the second lugs project downward from the sole bottom surface to a second lug bottom surface along a second lug axis, each of the second lugs being generally square in a cross section perpendicular to the corresponding second lug axis, each of the second lugs tapering away from the sole bottom surface.

* * * * *